US005221189A

United States Patent [19]

Henningsen

[11] Patent Number: 5,221,189

[45] Date of Patent: Jun. 22, 1993

[54] SOFT START FIRE PUMP CONTROLLER

[75] Inventor: Lee Henningsen, Raleigh, N.C.

[73] Assignee: Firetrol, Inc., Cary, N.C.

[21] Appl. No.: 927,846

[22] Filed: Aug. 10, 1992

[51] Int. Cl.[5] ..... F04D 15/00

[52] U.S. Cl. ..... 417/12; 417/18; 417/20; 417/32; 417/45; 417/53

[58] Field of Search ..... 417/12, 32, 45, 53, 417/18, 20

[56] References Cited

U.S. PATENT DOCUMENTS

| | | | |
|---|---|---|---|
| 1,634,875 | 7/1927 | Kimball | 417/12 |
| 3,544,235 | 12/1970 | Smith . | |
| 3,576,292 | 4/1971 | Block . | |
| 3,591,077 | 7/1971 | Alton et al. . | |
| 3,859,565 | 1/1975 | Henningsen . | |
| 3,953,152 | 4/1976 | Sipin . | |
| 3,974,879 | 8/1976 | Nelson, Jr. et al. . | |
| 4,124,332 | 11/1978 | Nishijyo . | |
| 4,220,440 | 9/1980 | Taylor et al. | 417/12 |
| 4,278,110 | 7/1981 | Price et al. . | |
| 4,290,735 | 9/1981 | Sulko | 417/53 |
| 4,344,741 | 8/1982 | Taki . | |
| 4,611,290 | 9/1986 | Henningsen et al. . | |
| 4,907,620 | 3/1990 | Becker . | |
| 5,158,436 | 10/1992 | Jensen et al. | 417/32 |

*Primary Examiner*—Richard A. Bertsch
*Assistant Examiner*—David W. Scheuermann
*Attorney, Agent, or Firm*—Collard & Roe

[57] ABSTRACT

A method and apparatus for controlling a fire pump motor for use in a building having a water supply for a fire protection system, a power line, and a pressure sensor. The pressure sensor detects a high or low system water pressure with respect to a reference water pressure. A voltage controller is coupled between the power line and the fire pump motor for controlling the voltage from the power line to the fire pump motor, responsive to indications from the pressure sensor. The voltage controller increases the voltage to the fire pump motor to full voltage and runs the fire pump motor at full voltage for a minimum run time and until high pressure is indicated. The voltage controller then decreases the voltage to the fire pump motor from full voltage to a predetermined voltage level. The voltage controller holds the voltage to the fire pump at the predetermined voltage level for a first preset period of time. The voltage controller thereafter decreases the voltage to the fire pump motor from the predetermined voltage level to zero. The voltage is increased any time low pressure is indicated. The voltage is subsequently decreased from full voltage, held at the predetermined level, and decreased to zero when high pressure is indicated.

19 Claims, 6 Drawing Sheets

VOLTAGE OUTPUT
AT
DT1
PT
DT1
PT
DT2
100%
AL
DL
50%
PL
0%
0 1 2 3 4 5 6 7 8 9 10 11 12 13 14 15 16
TIME (SEC.)
EVENT TIME
A B C D E F G
RUN COMMAND
CLOSED
OPEN
FULL VOLTAGE OUTPUT
CLOSED
OPEN
LED'S
RUN COMMAND
ON
OFF
FULL VOLTAGE OUTPUT
ON
OFF
RUN
ON
OFF

SOFT START FIRE PUMP CONTROLLER

BACKGROUND OF THE INVENTION

1. Field of the Invention

The present invention relates to a soft start fire pump controller for controlling the voltage of an electric fire pump during start up and shut down.

It has been found that electric motors which drive fire pumps in multi-story buildings draw large amounts of electrical power when brought on line. In addition, turning the motors on and off creates radical pressure changes in the water pipes. These radical pressure changes can result in a condition commonly referred to as water hammer. Water hammer can injure individuals who are using a standpipe hose, and damage the equipment in the buildings.

As a result, reduced voltage starting has been developed to control the start up and shut down phases of fire pump motors. Reduced voltage starting can be achieved with specially wound motors, or by adding resistors and/or transformers in series with the motor windings. Of these two methods, adding power control devices, i.e., resistors and/or transformers, in series with the motor windings is preferable because it can be used with any type of motor. These devices known as reduced voltage starters reduce normal starting power during the motor acceleration but only remove all power during the shut down phase of a fire pump motor.

The present invention relates to a soft starter which softly stops and, in addition, incorporates a pause period during the shut down phase of the fire pump motor to test for pump demand signals. Since the voltage is held at a preset intermediate level during the pause period, the soft starter can easily return the fire pump motor back to full voltage without causing radical changes in the water pressure.

2. The Prior Art

Reduced voltage devices are known to control the voltage during start up of fire pump motors, for example, by connecting resistors, reactors or autotransformers in series with the motor windings. These devices are triggered by pressure sensors which monitor the pressure in a building's water lines. If the pressure drops, for example, by the activation of a sprinkler head or standpipe hose, the pressure sensor initiates the reduced voltage starter. The reduced voltage starter would provide a less than line voltage to the motor and after a fixed time delay, bypass the reduced voltage equipment and directly connect the motor to the pump at full voltage. The reduced voltage starter would jump to 100% voltage and continue to operate the motor at 100% full voltage for a predetermined minimum period of time or until the pressure sensors indicate that pressure has been restored in the system, whichever is longer.

Once pressure is restored, the reduced voltage starter would disconnect the motor completely. Subsequently, if the pressure sensors indicate a low pressure condition, the reduced voltage starter will re-initiate the sequence to bring the motor back to full voltage and full running speed. A deficiency exists with the known systems in that starting and, particularly, stopping the motor may cause abrupt fluctuations in the water pressure possibly injuring fire fighting personnel and/or damaging fire protection equipment, water lines, pipes, valves, etc.

The applicant has previously patented fire pump control mechanisms for electric and diesel engines in U.S. Pat. Nos. 3,859,565 and 4,611,290. Other fire pump control mechanisms are disclosed in U.S. Pat. Nos. 3,974,879 and 3,544,235. Other control mechanisms are disclosed in U.S. Pat. Nos. 3,576,292, 3,591,077, 4,907,620, 3,953,152, 4,278,110, 4,344,741, and 4,124,332. However, none of these devices overcome the problems associated with prior art soft starters.

SUMMARY OF THE INVENTION

It is an object of the present invention to provide a soft start fire pump controller which overcomes the deficiencies of the prior art and more effectively controls the voltage of a fire pump motor.

It is a further object of the present invention to provide a soft start fire pump controller which pauses during the shut down phase of the fire pump motor.

It is still another object of the present invention to provide a soft start fire pump controller which eliminates radical pressure changes in sprinkler systems and/or standpipe hoses.

These and other related objects are achieved according to the invention by an apparatus and method for controlling the voltage of a fire pump motor with a soft start fire pump controller for operation in a building having a water supply for a fire protection system, a power line, and a pressure sensor. The method includes the steps of establishing a reference water pressure for the building and comparing the water pressure with the reference pressure. A low pressure signal is provided from the pressure sensor to the soft start fire pump controller, if the actual pressure is below the reference pressure. A high pressure signal is provided from the pressure sensor to the soft start fire pump controller, if the actual pressure is equal to or above the reference water pressure. The voltage is increased from the power line to the fire pump motor to full voltage. The fire pump motor is operated at full voltage in response to a low pressure signal, for a first predetermined period of time and until a high pressure signal is provided. Once the pressure has been restored and a high pressure signal is received, the voltage to the pump is decreased from full voltage. The voltage is held at a preset intermediate level for a second predetermined period of time following the decreasing of the voltage from full voltage. Thereafter, the voltage is decreased from the preset intermediate level to zero, following the step of holding the voltage. The pressure signals are continuously monitored during the steps of decreasing the voltage from full voltage, holding the voltage, and decreasing the voltage from the preset intermediate level. If a low pressure signal is received, the steps of increasing the voltage, decreasing the voltage from full voltage, holding the voltage, decreasing the voltage from the preset intermediate level and monitoring the pressure signals are repeated.

The apparatus according to the invention controls a fire pump motor for use in a building having a water supply for a fire protection system, a power line and a pressure sensor. The pressure sensor detects a high or low water pressure with respect to a reference water pressure. The apparatus includes a voltage controller or voltage control means coupled between the power line and the fire pump motor for controlling the voltage from the power line to the fire pump motor. The varying voltage is responsive to indications from the pressure sensor. The voltage controller increases the voltage to the fire pump motor to full voltage and runs the fire pump motor at full voltage for a minimum run time and until high pressure is indicated. The voltage controller decreases the voltage from full voltage to a predetermined level. The voltage is held at the predetermined level for a first preset period of time. Then the voltage is decreased from the predetermined level to zero. The voltage is increased any time low pressure is detected by the sensor. The voltage is subsequently decreased from full voltage, held at the predetermined voltage level and decreased to zero when high pressure is detected by the sensor.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
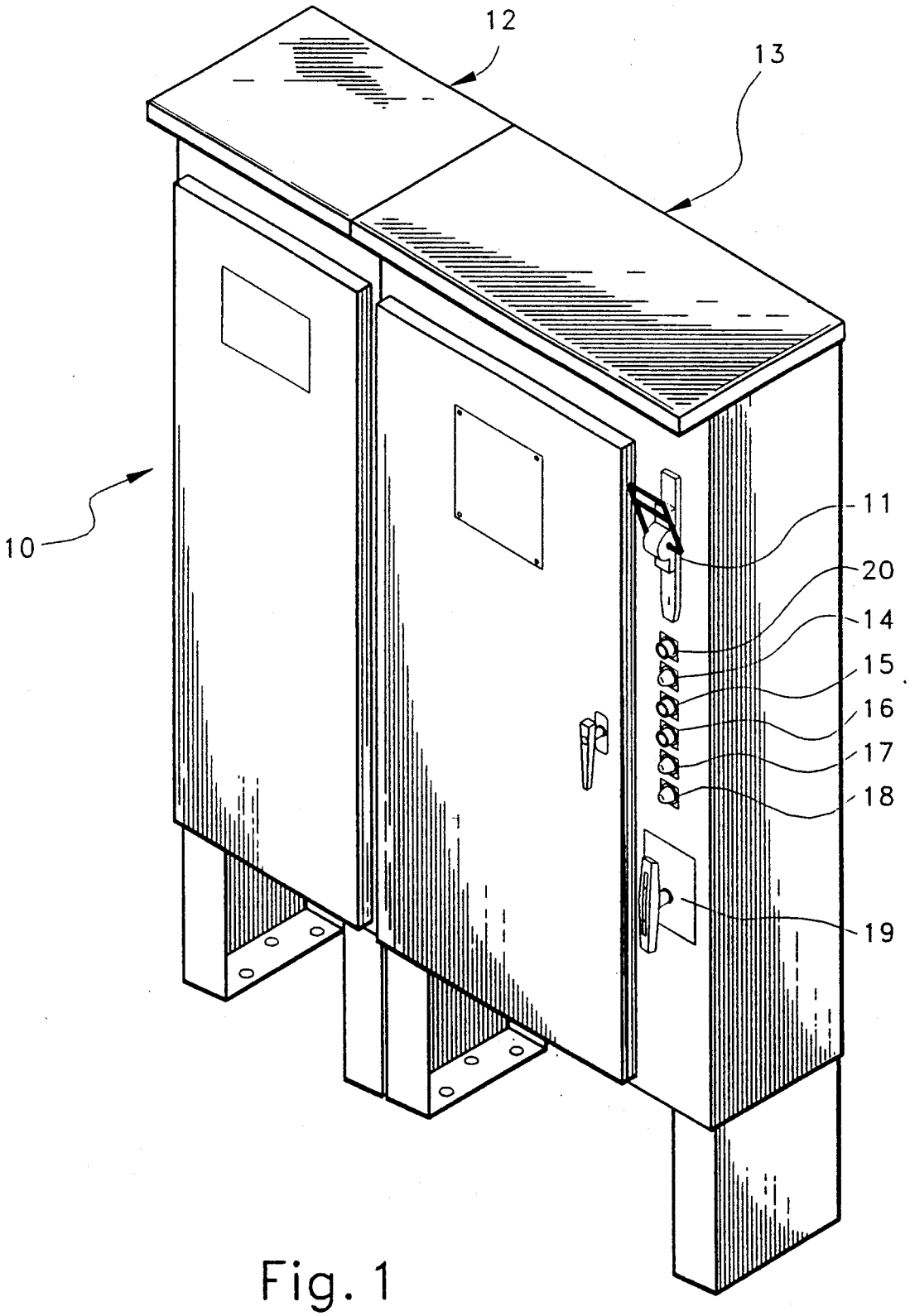
FIG. 1 is a perspective view of the soft start fire pump controller of the present invention.

Referring to the drawings and, in particular, to FIG. 1, there is shown a soft start fire pump controller 10 including a soft start cabinet 12 and a main fire pump controller cabinet 13. A disconnecting means operating handle 11 is provided for main fire pump controller cabinet 13 to disconnect the power for maintenance. Main fire pump controller cabinet 13 also includes a power on pilot light 14, a manual start push button 15, a soft stop push button 16, a phase reversal pilot light 17, a soft start SCR overtemperature pilot light 18, a manual emergency run operation handle 19, and an emergency stop push button 20.

Figure 2:
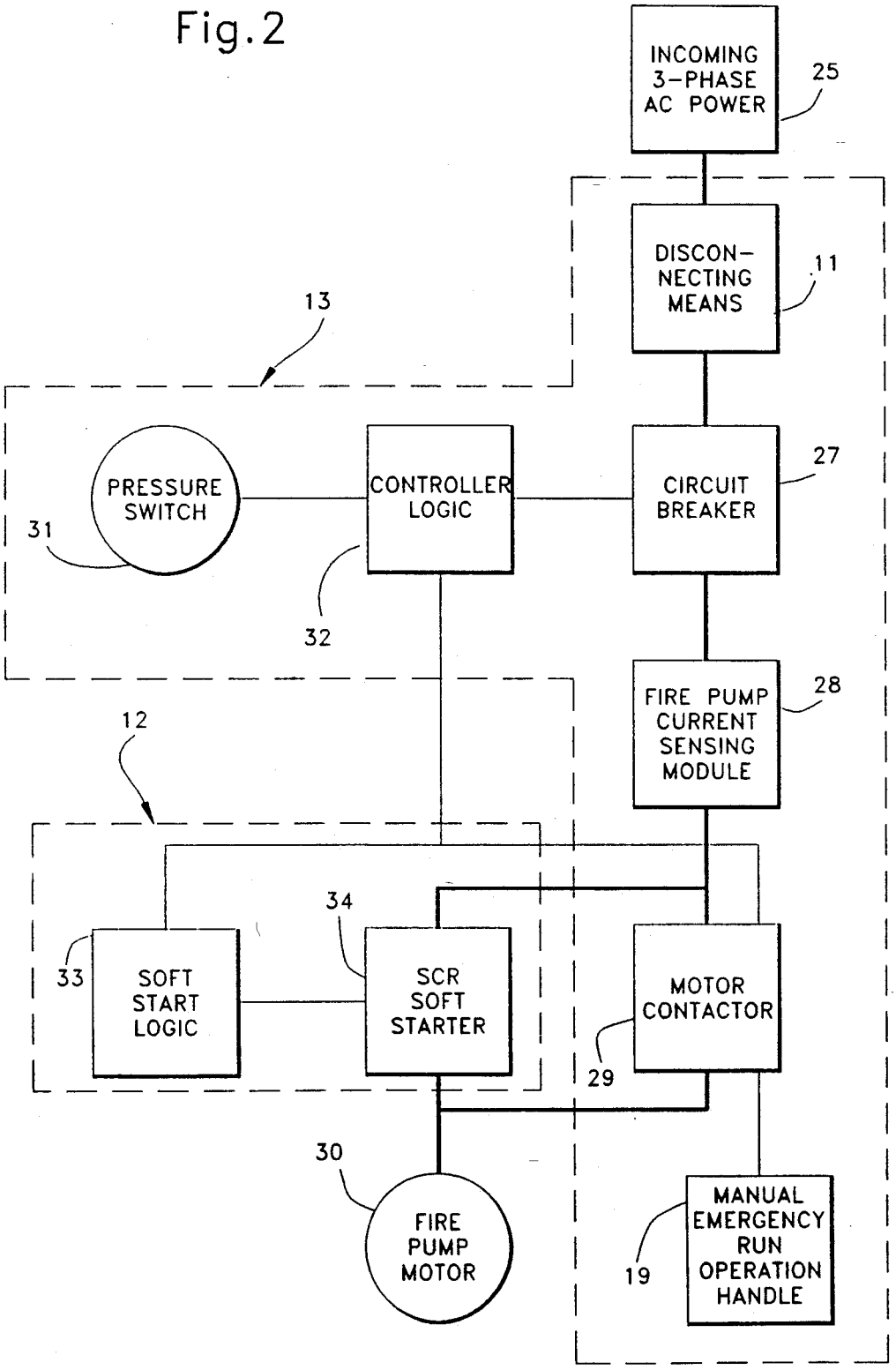
FIG. 2 is a block diagram of the major components contained in FIG. 1.

As can be seen in FIG. 2, main fire pump controller cabinet 13 is fed incoming three phase AC power 25 which is connected to disconnecting means operating handle 11, also shown in FIG. 1. A circuit breaker 27 is coupled to disconnecting means 11. A fire pump current sensing module 28 is coupled to circuit breaker 27. A motor contactor 29 connects fire pump current sensing module 28 to a fire pump motor 30. Manual emergency run operation handle 19, also shown in FIG. 1, is connected to motor contactor 29 for manual emergency override of the soft starter. A pressure switch 31 is connected to a controller logic 32 which is connected to circuit breaker 27. Controller logic 32 is connected to a soft starter logic 33 and motor contactor 29. An SCR soft starter 34 is connected to soft start logic 33 and is connected in parallel with motor contactor 29 for powering fire pump motor 30. Soft start logic 33 and SCR soft starter 34 are located in soft start cabinet 12 of FIG. 1. Except for incoming three phase AC power 25, and fire pump motor 30 all other components shown in FIG. 2 are located in main fire pump controller cabinet 13.

Figure 3:
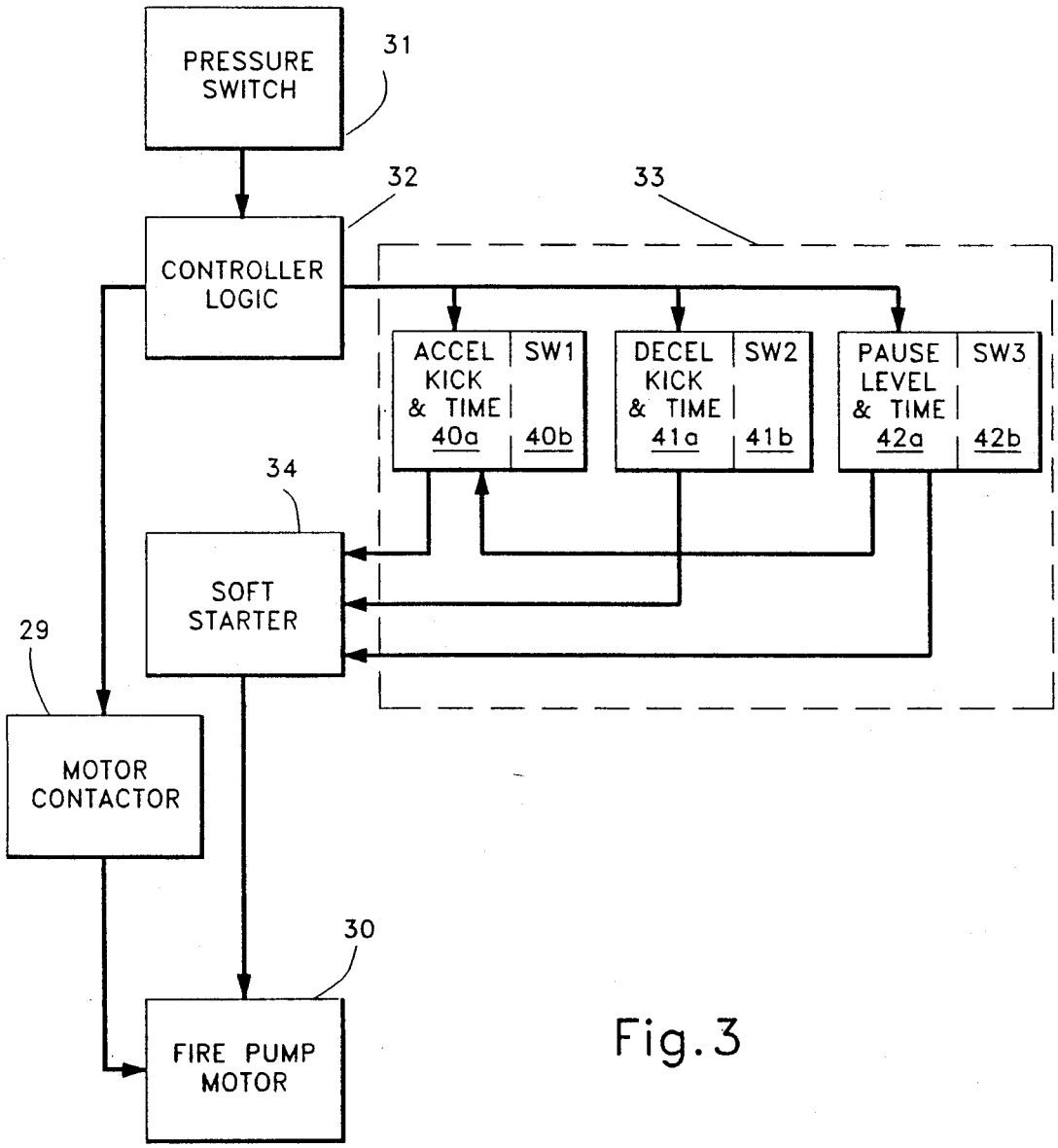
FIG. 3 is a detailed block diagram of the soft start logic of the present invention.

FIG. 3 is an electrical block diagram of certain components of the soft start fire pump controller including a detailed diagram of soft start logic 33 (also shown in FIG. 2). Pressure switch 31 and controller logic 32 are coupled to soft start logic 33 and motor contactor 29. Soft starter 34 is coupled between soft start logic 33 and fire pump motor 30. Controller logic 32 is coupled to three components of soft start logic 33, namely, acceleration kick and time circuit **40*a*, deceleration kick and time circuit 41*a*, and pause level and time circuit 42*a*. Each of these components can be programmed by a series of switches 40*b*, 41*b*, and 42*b*, respectively. These switches modify the voltage level and duration during the acceleration, deceleration and pause intervals to comply with the requirements of a particular building. Each module of soft start logic 33 is coupled to soft starter 34 for instructing soft starter 34 to accelerate (increase), decelerate (decrease) or hold the voltage constant that is provided to fire pump motor 30**.

Figure 4:
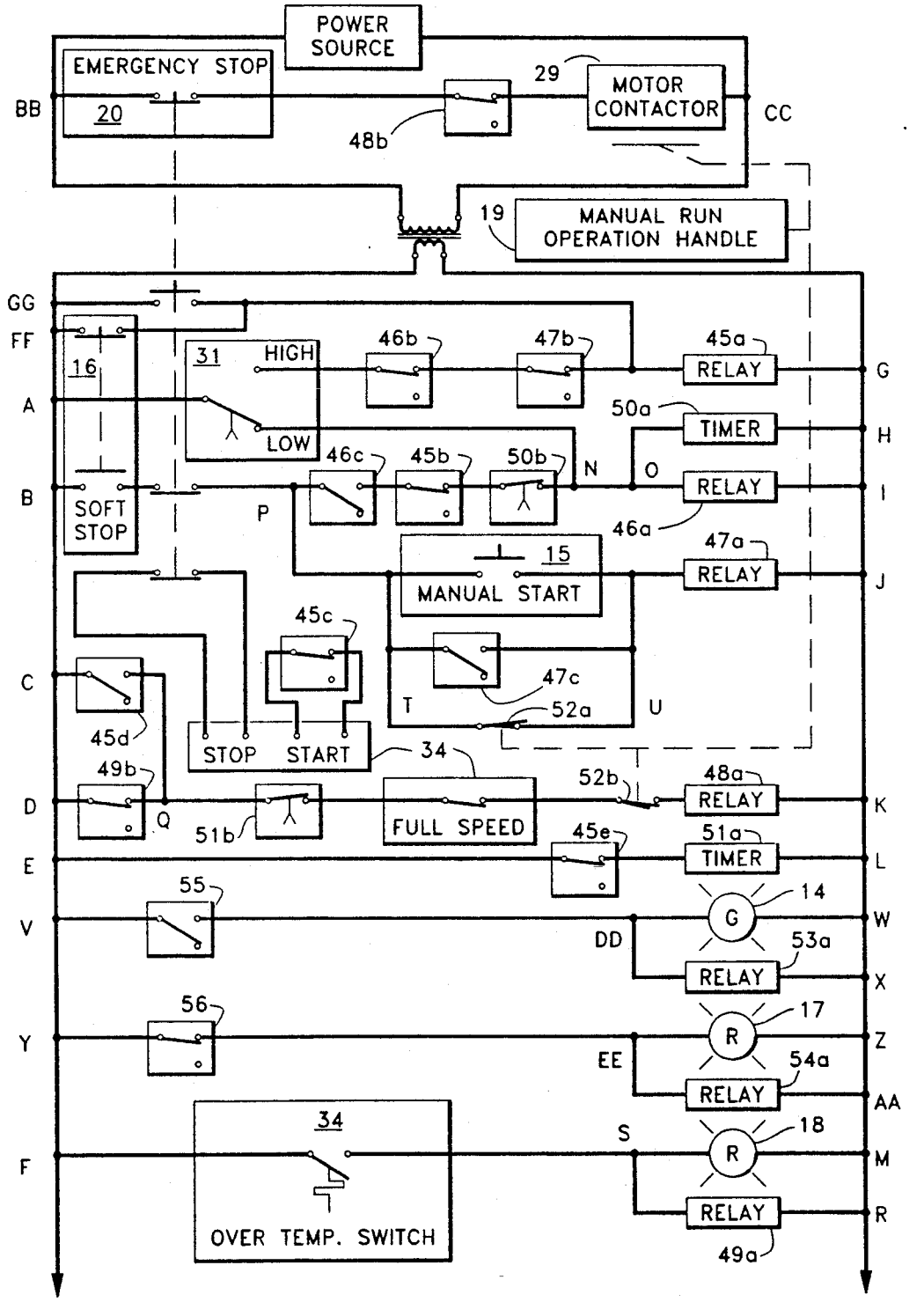
FIG. 4 is a schematic diagram of the soft start fire pump controller.

In FIG. 4, note that reference numerals 45, 46, 47, 48, 49, 53 and 54 followed by a lower case "a" are relays. The subsequent letter designations, i.e., "**45*b*", "45*c*", etc., are relay contacts of the corresponding "45*a*" relay. Similarly, 50*a* and 51*a* refer to timers with subsequent letter designations, i.e., "50*b*", "50*c*" representing timer contacts of the corresponding "50*a*" timer. Pressure switch 31, which is usually in the high position, will complete the circuit from node "A" to node "G" including relay contacts 46*b*, 47*b* and relay 45*a* in series. When pressure switch 31 is in the low position, it completes the circuit from node "A" to node "H" via timer 50*a* and node "I" via relay 46*a*. Timer 50*a* and relay 46*a* are connected in parallel. In addition, relay contact 46*c*, relay contact 45*b* and timer contact 50*b* are connected in series between nodes "B" and "N". Manual start push button 15 and relay 47*a*** are connected between node "P" and node "J" and is parallel to the line between node "P" and node "I".

Relay contact **45*c* is connected to the start terminals of soft starter 34. Relay contact 45*d* is connected between nodes "C" and "Q". Relay contact 49*b* is connected in parallel with 45*d* between nodes "D" and "Q." Timer contact 51*b* is in series with the relay contacts 49*b* and 45*d*. In addition, a full speed monitor of soft starter 34 and relay 48*a* are connected in series through nodes "Q" and "K." Relay contact 45*e* and timer 51*a* are connected in series across nodes "E" and "L". Phase monitor switch 55 is connected in series with power on pilot light 14 between nodes "V" and "W". Alarm relay 53*a* is connected in parallel with pilot light 14 between nodes "DD" and "X". Phase monitor switch 56 is connected in series with phase reversal pilot light 17 between nodes "Y" and "Z". Alarm relay 54*a* is connected in parallel with phase reversal pilot light 17** between nodes "EE" and "AA".

The overtemperature switch of soft starter 34 is connected in series with the overtemperature pilot light 18 between nodes "F" and "M". In addition, the overtemperature relay **49*a* is connected in parallel with the overtemp. pilot light 18 through nodes "S" and "R". Manual emergency run operation handle 19 is connected to motor contactor 29. In addition, it is connected to cut off switches 52*a* and 52*b*. Soft stop push button 16 is connected between nodes "FF" and "G" in series with relay 45a and between nodes "B" and "P". Emergency stop push button 20 is connected between nodes "BB" and "CC" in series with motor contactor 29, between nodes "GG" and "G" in series with relay 45a, between nodes "B" and "B" and to the stop terminals of soft starter 34**.

Figure 5:
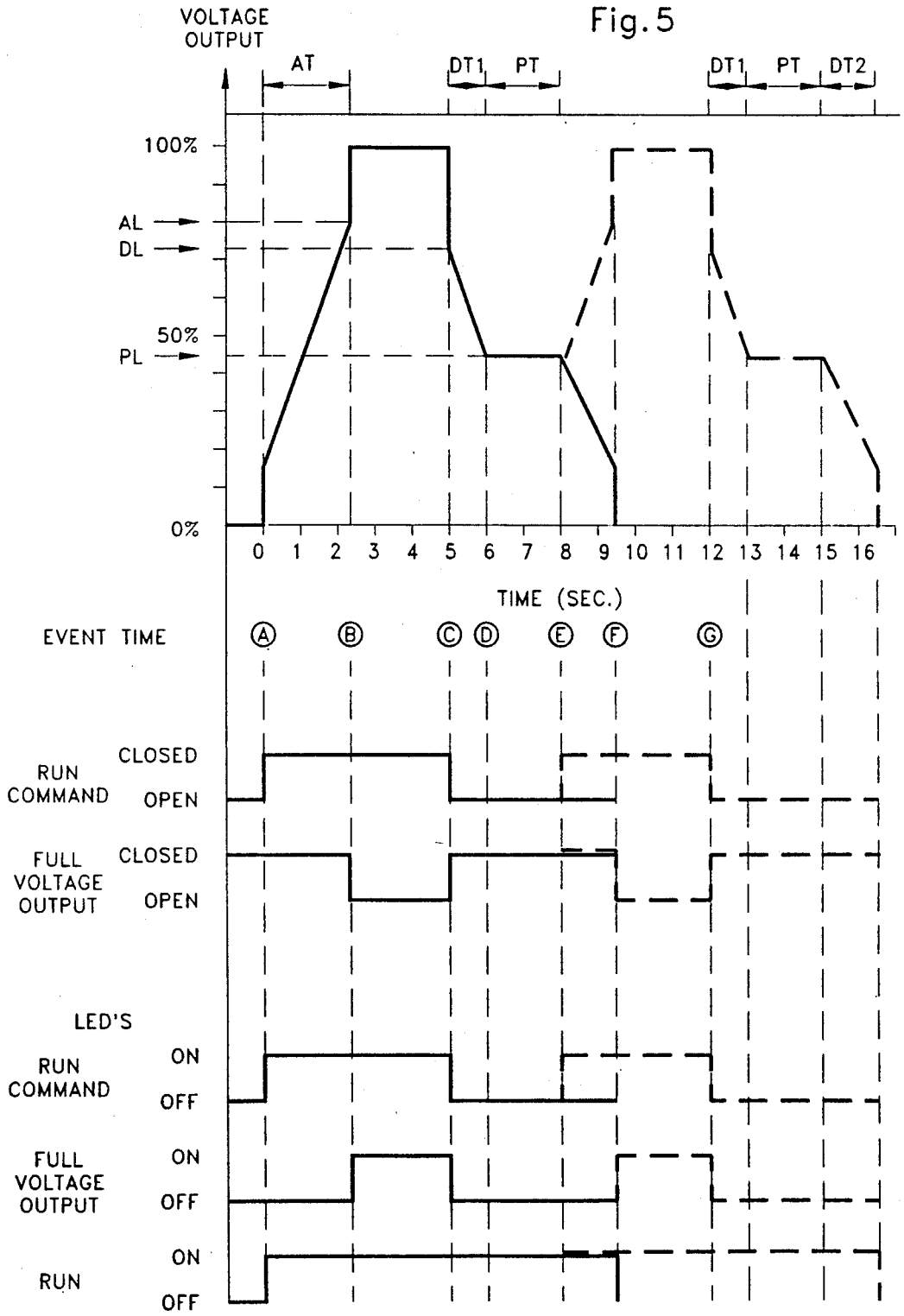
FIG. 5 is a plot of the operation of the soft start fire pump controller showing the percent of voltage output to the fire pump motor as a function of time.
Figure 6:
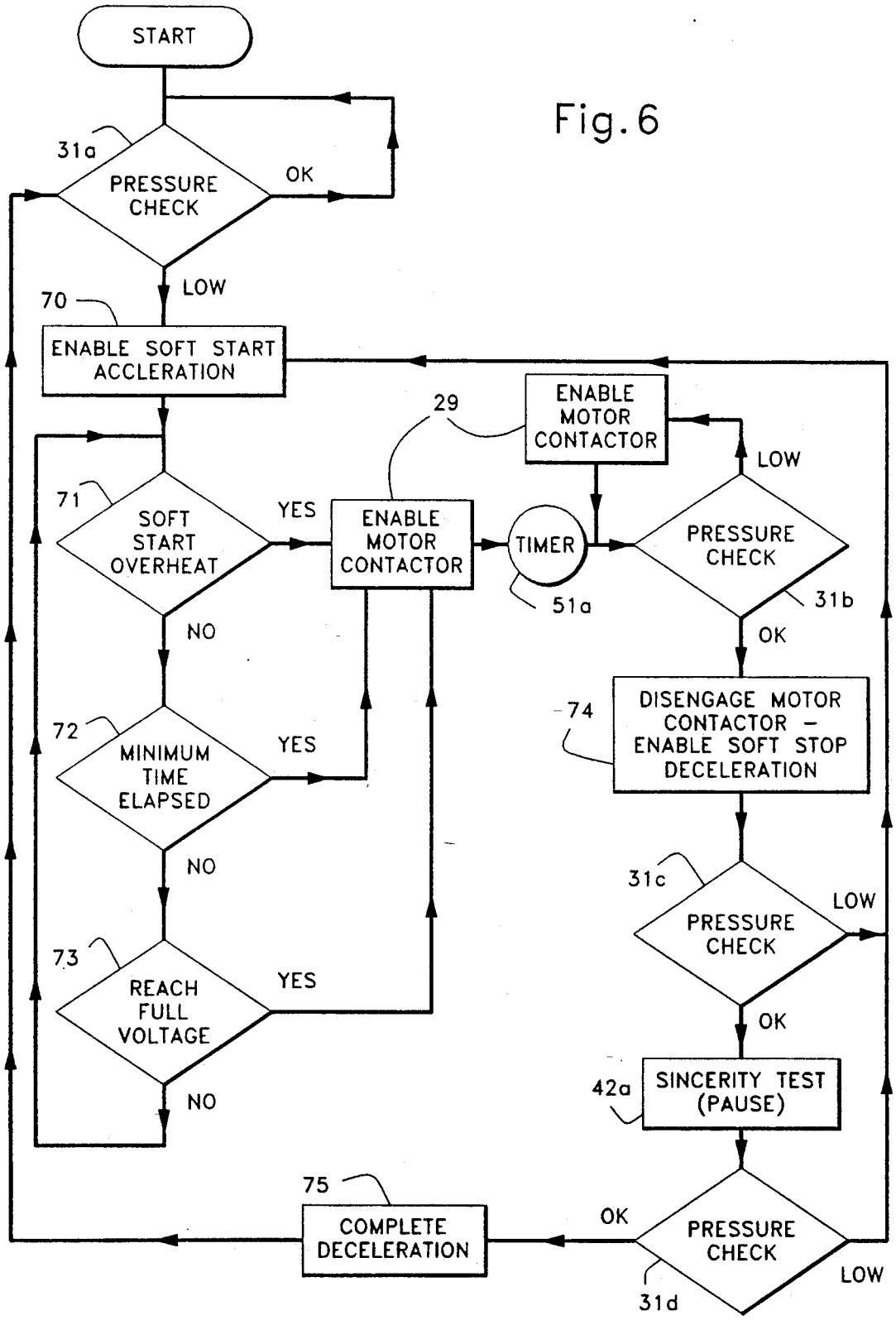
FIG. 6 is a flow chart diagram of the soft start operation of the fire pump controller.

FIG. 5 shows a plot of the starter operation in conjunction with soft start logic 33. FIG. 6 is a flow chart showing the various steps of the soft starter.

In operation, the soft starter would operate as follows, reference being made to FIG. 6. Ordinarily, pressure switch 31a indicates that adequate pressure exists within the water pipes of the building. These water pipes feed the automatic sprinklers as well as the standpipe hoses which would be manually operated in the event of a fire. As long as pressure switch 31a indicates adequate pressure in the system, the system will remain in a ready wait state. When a fire begins, typically one or more temperature sensitive sprinkler heads will activate, depending on the size of the fire. Water flowing from the sprinkler heads would reduce the pressure in the pipes, causing pressure switch 31a to indicate a low pressure condition. Step 70 shows that a low pressure condition enables the soft start acceleration.

Referring to FIG. 2, the low pressure signal is received by controller logic 32 from pressure switch 31. Controller logic 32 initiates soft start logic 33, which operates SCR soft starter 34. The soft starter gradually increases the voltage to motor 30 and when motor 30 reaches full voltage, as indicated by soft start logic 33, motor contactor 29 is closed in parallel with SCR soft starter 34. In the event of a failure to reach full voltage after a predetermined period of time, a timer in controller logic circuit 32 will automatically close motor contactor 29.

Referring to FIG. 3, acceleration kick and time module 40a instructs soft starter 34 to increase the voltage to pump 30. The acceleration time (slope of the voltage curve) and kick time (time at which 100% voltage is achieved) are controlled by module 40a and are adjustable through DIP switches 40b. The acceleration time is adjustable in the range of 2.5 to 7.0 seconds, i.e., time required to increase from 0% voltage to 100%. The acceleration kick level, that is the percentage of voltage level at which soft starter 34 will step up to full voltage output, is adjustable in the range of 70% to 95% of voltage output. Motor 30 will operate at full voltage output for a minimum run time or until the pressure in the system is back to normal, whichever is longer.

Referring to FIG. 4, when pressure switch 31 switches to low pressure, numerous reactions result:

1. A relay 45a de-energizes thereby closing a relay contact 45c, thus starting SCR soft starter 34 and pump motor 30;

2. A relay contact 45d opens thus allowing a relay contact 49b (overtemperature relay) to control the signal to a relay 48a. If relay contact 49b is closed, nothing happens. If relay contact 49b opens (due to overtemperature), relay 48a de-energizes thus closing relay contact 48b which closes motor contactor 29 delivering full voltage to motor 30.

3. Upon the de-energization of relay 45a, relay contact 45e closes thereby initiating the timing cycle of a timer 51a. Timer 51a has an adjustable range of 0.6 to 10 seconds. When the timing cycle is complete, or if soft starter 34 reaches full speed, timer contact 51b opens thereby de-energizing relay 48a. Upon the de-energization of 48a, relay contact 48b closes energizing motor contactor 29, thus bypassing the soft starter 34.

4. Relay 46a and timer 50a are energized. Relay contact 46c closes thereby holding relay 46a energized. In addition, relay contact 46b opens preventing relay 45a from re-energizing, i.e., re-initializing, in the event that pressure switch 31 returns to a high pressure state. Timer 50a has an adjustable range of 0.3 to 30 minutes which provides a minimum run time at full voltage.

FIG. 5 shows the output voltage of soft starter 34 to fire pump motor 30. At event time (A), the "run command" is received, i.e., a drop in the system's pressure indicated by pressure switch 31. Soft starter 34 immediately supplies approximately 15% output voltage to the motor. This voltage increases at a rate selected with the "acceleration time" adjustment 40b (as shown in FIG. 3).

At event time (B), the "kick" level "KL" is reached. At this point, the output voltage immediately steps up to 100%. The "kick" level "KL" can be adjusted by dip switches 40b (as shown in FIG. 3).

Referring to FIG. 6, following enablement of soft start acceleration 70, motor contactor 29 is enabled, if any of the following three conditions are met: the soft starter overheat 71 is triggered; the minimum elapsed time 72 expires; or, the starter reaches full voltage 73. As seen in FIG. 4, following the closing of motor contactor 29, timer 51a is initiated to begin a minimum run time at full voltage. Referring to FIG. 6, when timer 51a has timed out, pressure check 31b continues to monitor the pressure and will continue to hold motor contactor 29 closed as long as a low pressure signal is received. If pressure check 31b indicates that the pressure is high, then motor contactor 29 will be disengaged and the soft start deceleration will be enabled, as per step 74.

Referring to FIG. 2, after a minimum run time and when the pressure has returned to normal, controller logic circuit 32 will initiate a stop sequence. SCR soft starter 34 is on line at full voltage. Motor contactor 29 will open and SCR soft starter 34 will then reduce voltage and hold at a preset positive voltage level, thus reducing motor RPM and subsequently pump output pressure. This pause during voltage reduction acts as a "sincerity test" on pressure switch 31 and the system flow requirements. It minimizes power inrush and system pressure surges. It determines whether a reduced motor RPM will lower the system pressure to a point where re-acceleration is required without decelerating fully to zero speed.

Referring to FIG. 3, upon the initiation of the stop sequence, soft start logic 33 will then begin its deceleration cycle 41a. This cycle 41a controls the deceleration kick down from full voltage and the deceleration ramp time. DIP switch 41b allows for the adjustability of the deceleration step down from full voltage and the deceleration ramp duration. The deceleration step down is adjustable in the range of 70% to 95% voltage output, i.e., the initial drop from 100% voltage. Once the step down is complete, the deceleration ramp begins. The deceleration ramp duration is adjustable in the range of 2.5 to 7.0 seconds.

Referring to FIG. 4, when timer contact 50b opens, after time as indicated by timer 50a is elapsed and the pressure is satisfactory (i.e., pressure switch 31 indicates a high pressure condition), relay 46a de-energizes thereby closing relay contact 46b, thus allowing relay 45a to energize and re-initialize. Relay 45a will therefore re-initiate the acceleration sequence when de-energized by pressure switch 31 indicating a low pressure condition. Relay contact 45c opens upon the energization of 45a and starter 34 begins its stop routine.

When the stop routine begins, relay contact 45d and timer contact 51b reset to standby state, that is, both close allowing relay 48a to energize. Upon the energization of 48a, relay contact 48b opens thereby opening motor contactor 29 and allowing starter 34 to ramp down pump motor 30.

Referring to FIG. 5, starter 34 continues to supply full output voltage until event time (C), when the minimum run time has elapsed and the pressure in the system returns to a normal state. At this time, the voltage steps down from 100% to the "deceleration level"—"DL". The output voltage then decreases at a rate selected with the deceleration time adjustment 41b (as shown in FIG. 3), until a pause level "PL" is reached.

As shown in FIG. 6, during the deceleration of step 74, the pressure level is constantly monitored in step 31c. If a low pressure signal is received, then step 70 which enables the soft start acceleration will be reinitiated. If during the deceleration of step 74, the pressure check 31c shows an adequate pressure, then a sincerity test (pause) 42a follows. During sincerity test 42a, the voltage stops decelerating and is held at a constant level. During sincerity test 42a, the pressure is constantly monitored by 31d. If at any point a low pressure signal is obtained, then soft start acceleration step 70 is reinitiated. If pressure switch 31d shows an adequate pressure level, then complete deceleration 75 will occur. Following step 75, the system will return to a ready state awaiting a low pressure signal from pressure switch 31a.

Referring to FIG. 2, this unique pause during deceleration allows sufficient time for controller logic 32 to sense another low pressure condition, while maintaining a positive but reduced pressure in the system.

Referring to FIG. 3, should controller logic 32 sense another low pressure during pause level and time 42a, soft start logic 33 will turn control over to acceleration kick and time 40a to bring motor 30 back up to full voltage. Since the sincerity test maintains positive pressure in the system, the effects of water hammer are reduced in the event that a standpipe hose is in use. Advantageously, the operators of any standpipe hoses are less likely to be thrown about by radical changes in system pressure. DIP switches 42b controls the pause level and time duration for the sincerity test. The pause time duration has an adjustable range of 2.0 to 6.0 seconds. The pause level—"PL" has an adjustable output voltage in the range of 32% to 60%.

If the pressure is adequate, soft starter 34 will allow the motor to continue to ramp down to a full stop (as shown in step 75 of FIG. 6). The additional ramp down time will allow a sufficiently gradual reduction in system pressure to greatly reduce or eliminate water hammer. Controller logic 32 will return to a standby mode awaiting a low pressure condition.

Referring to FIG. 5, at event time (D), the deceleration ramp will stop and come to a pause level—"PL". This pause level is then held for an adjustable pause time (sincerity test). After the end of the pause time, at event time (E), the output voltage once again decreases until 10 to 15% output voltage is reached, (at event time (F). At this point, the starter shuts off completely.

During the pause level, i.e., between events time (D) and (E), the pressure level is continuously monitored by pressure check 31d of FIG. 6. At any point therefore between event time (D) and (E), a low pressure signal will re-activate soft starter acceleration shown in FIG. 6 as step 70. As can be seen in FIG. 5, at event time (E), the voltage could be accelerated back up to level (KL) and then brought to full voltage. The dotted line of FIG. 5 therefore shows the starter activity if a run command is received during voltage level (PL) at event time (E). The dotted plot beginning at event time (E) accelerates the voltage from level (PL) up to full voltage event time (F). Thus, the time to reach full voltage is significantly reduced as compared to the initial acceleration from event time (A) to event time (B).

Since the voltage output has fluctuated from 100% to (PL) back to 100%, the system pressure has been maintained during the entire time since event time (A). Once the voltage has reached 100% at event time (F), timer 51a is reinitialized and the pump is run at 100% for a predetermined amount of time. From event time (G) forward, the pressure is continuously monitored and if adequate pressure is maintained, soft starter 34 will reduce voltage, pause at level (PL), and continue to reduce the voltage to 0.

While only a single embodiment of the present invention has been shown and described, it is to be understood that many changes and modifications may be made thereunto without departing from the spirit and scope of the invention as defined in the appended claims.

What is claimed is:

1. A method for controlling the voltage of a fire pump motor with a soft start fire pump controller for operation in a building having a water supply for a fire protection system, a power line and a water pressure sensor, comprising the steps of:

establishing a reference water pressure for the building;

comparing the water pressure with the reference water pressure and providing a low pressure signal if the water pressure is below the reference pressure, and providing a high pressure signal if the water pressure is equal to or above the reference water pressure;

increasing the voltage from the power line to the fire pump motor to full voltage in response to a low pressure signal and operating at full voltage for a first predetermined period of time and until a high pressure signal is provided;

decreasing the voltage to the pump from full voltage to a preset intermediate level following the step of increasing the voltage;

holding the voltage at a preset intermediate level for a second predetermined period of time following the step of decreasing the voltage from full voltage;

decreasing the voltage from the preset intermediate level to zero following the step of holding the voltage;

monitoring the pressure continuously during said steps of decreasing the voltage from full voltage, holding the voltage and decreasing the voltage from the preset intermediate level and if a low pressure signal is provided, repeating the steps of increasing the voltage, decreasing the voltage from full voltage, holding the voltage, decreasing the voltage from the preset intermediate level and monitoring the pressure.

2. The method according to claim 1, whereas the step of increasing the voltage includes:

bringing the fire pump motor on line at a first predetermined voltage level;

increasing the voltage to the fire pump motor from the first predetermined voltage level to a second predetermined voltage level;

stepping up the voltage to the fire pump motor from said second predetermined voltage level to full voltage.

3. The method according to claim 2, whereas the step of decreasing the voltage from full voltage includes:

stepping down the voltage to said fire pump motor from full voltage to a third predetermined voltage level; and decreasing the voltage from the third predetermined voltage level to the preset intermediate level.

4. The method according to claim 3, whereas the step of decreasing the voltage from the preset intermediate level includes:

decreasing the voltage from the preset intermediate level to a fourth predetermined voltage level; and taking the fire pump motor off line.

5. The method according to claim 4, following said step of increasing the voltage, additionally including the step of:

closing a motor contactor in parallel with said soft start fire pump controller when said fire pump motor is at full voltage.

6. The method according to claim 5, additionally including the step of:

closing the motor contactor after a third predetermined period of time following a low pressure signal.

7. The method according to claim 5, additionally including the step of:

closing the motor contactor manually to override the soft start fire pump controller in the event of an emergency.

8. The method according to claim 7, additionally including the step of:

programming the first predetermined voltage level, the second predetermined voltage level, the third predetermined voltage level, the fourth predetermined voltage level, the preset intermediate level, the first predetermined period of time, the second predetermined period of time and the third predetermined period of time for the building, prior to said step of establishing a reference water pressure for the building.

9. An apparatus for controlling a fire pump motor for use in a building having a water supply for a fire protection system, a power line and a pressure sensor for detecting a high or low system water pressure with respect to a reference water pressure, comprising;

voltage control means coupled between the power line and the fire pump motor for controlling the voltage from the power line to the fire pump motor in response to indications from the pressure sensor, said voltage control means:

i) increasing the voltage to the fire pump motor to full voltage and running the fire pump motor at full voltage for a minimum run time and until high pressure is indicated;

ii) decreasing the voltage to the fire pump motor from full voltage to a predetermined voltage level;

iii) holding the voltage to the fire pump motor at the predetermined voltage level for a first preset period of time;

iv) decreasing the voltage to the fire pump motor from the predetermined voltage level to zero, so that the voltage is increased any time low pressure is detected by the sensor and the voltage is subsequently decreased from full voltage, held at the predetermined voltage level and decreased to zero when high pressure is detected by the sensor.

10. The apparatus according to claim 9, whereas said voltage control means comprises:

an acceleration module for increasing the voltage to the fire pump motor to full voltage;

a deceleration module for decreasing the voltage from full voltage and decreasing the voltage from the predetermined voltage level to zero; and a pause module for holding the voltage at a predetermined voltage level for a first preset period of time.

11. The apparatus according to claim 10, whereas said acceleration module includes acceleration adjusting means for setting the minimum run time and the parameters for increasing the voltage, said deceleration module includes deceleration adjusting means for setting the parameters for decreasing the voltage and said pause module includes pause adjusting means for setting the predetermined voltage level and the first preset period of time.

12. The apparatus according to claim 11, whereas said voltage control means further includes a power control device which is connected in series to the windings of the fire pump motor.

13. The apparatus according to claim 12, further including a motor contactor connected to the fire pump motor in parallel with said power control device, said motor contactor providing full voltage to said fire pump motor.

14. The apparatus according to claim 13, additionally including a controller logic coupled to said power control device and said motor contactor for closing said motor contactor in parallel with said power control device when the fire pump motor is at full voltage.

15. The apparatus according to claim 14, whereas said controller logic closes said motor contactor in parallel with said power control device from the fire pump motor, after a second preset period of time following a low pressure signal.

16. The apparatus according to claim 15, whereas said controller logic closes said motor contactor and disconnects said power control device from the fire pump motor if said voltage control means overheats.

17. The apparatus according to claim 16, additionally including a manual run handle coupled to said motor contactor for closing said motor contactor manually in the event of an emergency.

18. The apparatus according to claim 17, wherein the fire protection system is a sprinkler system.

19. The apparatus according to claim 17, wherein the fire protection system is a standpipe.

* * * * *